US010372069B2

(12) United States Patent
Yamana et al.

(10) Patent No.: US 10,372,069 B2
(45) Date of Patent: Aug. 6, 2019

(54) IMAGE FORMING APPARATUS HAVING A CONTROL PORTION CAPABLE OF CONTROLLING A ROTATION SPEED OF A PAIR OF CONVEYANCE MEMBERS

(71) Applicant: CANON KABUSHIKI KAISHA, Tokyo (JP)

(72) Inventors: Kentaro Yamana, Kashiwa (JP); Yuichi Tanabe, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/212,351

(22) Filed: Jul. 18, 2016

(65) Prior Publication Data

US 2017/0038714 A1 Feb. 9, 2017

(30) Foreign Application Priority Data

Aug. 6, 2015 (JP) ..... 2015-156176

(51) Int. Cl.
*G03G 15/00* (2006.01)
*G03G 15/16* (2006.01)
*G03G 15/20* (2006.01)

(52) U.S. Cl.
CPC ..... *G03G 15/2053* (2013.01); *G03G 15/167* (2013.01); *G03G 15/1615* (2013.01);
(Continued)

(58) Field of Classification Search
CPC .... G03G 15/14; G03G 15/16; G03G 15/1665; G03G 15/167; G03G 15/1615;
(Continued)

(56) References Cited

U.S. PATENT DOCUMENTS 5,159,393 A * 10/1992 Hiroshima ..... G03G 15/167 399/313
5,434,027 A 7/1995 Oshiba et al.
(Continued)

FOREIGN PATENT DOCUMENTS

CN 1442762 A 9/2003
CN 1804734 A 7/2006
(Continued)

OTHER PUBLICATIONS

Office Action (with English translation) dated Apr. 30, 2019, issued in corresponding Chinese Patent Application No. 201610622670.6.
(Continued)

*Primary Examiner* — David H Banh
(74) *Attorney, Agent, or Firm* — Venable LLP

(57) ABSTRACT

An image forming apparatus includes a control portion that controls a drive speed of a first drive source, so that a speed of a sheet conveyed in a conveyance nip portion is greater than a speed of the sheet conveyed in a transfer nip portion, and a drive speed of a second drive source, so that the speed of the sheet conveyed in the transfer nip portion is greater than a speed of the sheet conveyed in a fixing nip portion. The control portion changes a rotation speed of a pair of conveyance members from a first speed to a second speed greater than the first speed after a first loop amount of the sheet formed between the transfer nip portion and the fixing nip portion becomes greater than a second loop amount of the sheet formed between the transfer nip portion and the conveyance nip portion.

16 Claims, 5 Drawing Sheets

(52) U.S. Cl.
CPC ..... *G03G 15/2017* (2013.01); *G03G 15/55* (2013.01); *G03G 15/6529* (2013.01); *G03G 15/6591* (2013.01); *G03G 15/6594* (2013.01); *G03G 2215/2045* (2013.01)

(58) Field of Classification Search
CPC .... G03G 15/1605; G03G 15/20; G03G 15/22; G03G 15/2053; G03G 15/2017; G03G 15/55; G03G 15/6529; G03G 15/6591; G03G 15/6594; G03G 2215/2045
See application file for complete search history.

(56) References Cited

U.S. PATENT DOCUMENTS

| | | | | |
|---|---|---|---|---|
| 6,278,859 | B1 * | 8/2001 | Nagano | G03G 15/6573 399/316 |
| 6,892,038 | B2 | 5/2005 | Fukutani | |
| 7,289,744 | B2 | 10/2007 | Shirakata et al. | |
| 7,574,153 | B2 | 8/2009 | Nakayama et al. | |
| 7,751,741 | B2 | 7/2010 | Hirai | |
| 8,260,179 | B2 | 9/2012 | Miura et al. | |
| 2005/0242493 | A1 * | 11/2005 | Agata | B65H 5/062 271/226 |
| 2007/0110464 | A1 * | 5/2007 | Nakayama | G03G 15/6529 399/45 |
| 2008/0292360 | A1 | 11/2008 | Hirai | |
| 2009/0309291 | A1 | 12/2009 | Yasui et al. | |
| 2010/0140862 | A1 * | 6/2010 | Yamaguchi | B41J 13/03 271/10.11 |
| 2010/0310281 | A1 * | 12/2010 | Miura | G03G 15/0131 399/298 |
| 2011/0150548 | A1 * | 6/2011 | Kasuga | B65H 5/062 399/388 |
| 2011/0158724 | A1 * | 6/2011 | Fujita | G03G 15/6567 399/395 |
| 2013/0064583 | A1 * | 3/2013 | Yoshida | G03G 15/2025 399/327 |
| 2017/0068199 | A1 * | 3/2017 | Fujita | G03G 15/6529 |

FOREIGN PATENT DOCUMENTS

| | | | |
|---|---|---|---|
| CN | 101746160 | A | 6/2010 |
| CN | 101907853 | A | 12/2010 |
| JP | 06-194854 | A | 7/1994 |
| JP | 08-146789 | A | 6/1996 |
| JP | 10-97154 | A | 4/1998 |
| JP | 2002-031965 | A | 1/2002 |
| JP | 2002-169344 | A | 6/2002 |
| JP | 2002-215000 | A | 7/2002 |
| JP | 2004-101925 | A | 4/2004 |
| JP | 2004-354695 | A | 12/2004 |
| JP | 2006-248670 | A | 9/2006 |
| JP | 2007-139882 | A | 6/2007 |
| JP | 2008-151879 | A | 7/2008 |
| JP | 2008-287145 | A | 11/2008 |
| JP | 2009-282450 | A | 12/2009 |
| JP | 2009-294435 | A | 12/2009 |
| JP | 2012-236684 | A | 12/2012 |
| JP | 2013-057841 | A | 3/2013 |

OTHER PUBLICATIONS

Office Action dated May 21, 2019, issued in corresponding Japanese Patent Application No. 2015-156176.

* cited by examiner

IMAGE FORMING APPARATUS HAVING A CONTROL PORTION CAPABLE OF CONTROLLING A ROTATION SPEED OF A PAIR OF CONVEYANCE MEMBERS

This application claims the benefit of Japanese Patent Application No. 2015-156176, filed Aug. 6, 2015, which is hereby incorporated by reference herein in it entirety.

BACKGROUND OF THE INVENTION

Field of the Invention

The present invention relates to an image forming apparatus configured to form a toner image on a recording material through use of an electrophotographic printing method, such as a copying machine, a printer, a fax machine, or a multifunctional apparatus having a plurality of functions thereof.

Description of the Related Art

In an image forming apparatus employing an electrophotographic printing method, a toner image is transferred onto a recording material in a transfer portion, and then is heated and pressurized by a fixing device to be fixed onto the recording material. Regarding such a configuration, in Japanese Patent Application Laid-Open No. H10-97154, there is described an image forming apparatus in which the conveyance speed of a recording sheet in a nip portion (fixing nip portion) of a fixing device is set to be less than that of a recording sheet (recording material) in a transfer portion (transfer nip portion). With this configuration, the recording sheet is prevented from being pulled between the fixing nip portion and the transfer nip portion, to thereby prevent distortion of an image caused by pulling of the recording sheet.

In the image forming apparatus described in Japanese Patent Application Laid-Open No. H10-97154, due to a difference in conveyance speed between the fixing nip portion and the transfer nip portion, the recording sheet has a flexed shape between the fixing nip portion and the transfer nip portion. When the recording sheet is flexed as described above, a force is exerted on an image bearing member that is brought into contact with the recording sheet in the transfer nip portion, in a direction opposite to the rotation direction of the image bearing member due to a rigidity (stiffness) of the recording sheet. When the rotation speed of the image bearing member is changed with such a force, an image defect, such as color misregistration, may be caused.

In view of the foregoing, it is conceivable that the force exerted on the image bearing member due to flexure of the recording material between the transfer nip portion and the fixing nip portion is canceled out by flexing the recording material on an upstream side of the transfer nip portion. When the recording material is brought into contact with the image bearing member at an upstream position of the transfer nip portion in a state in which the recording material is significantly flexed on the upstream side of the transfer nip portion, however, a toner image borne on the image bearing member may be distorted to cause an image defect.

SUMMARY OF THE INVENTION

According to one embodiment, the present invention provides an image forming apparatus comprising a movable endless belt, a toner image forming unit configured to form a toner image on the belt, a transfer rotary member forming, between the transfer rotary member and the belt, a transfer nip portion configured to transfer the toner image borne on the belt onto a recording material, the recording material being conveyed at a speed of Vt in the transfer nip portion, a pair of conveyance members arranged upstream of the transfer nip portion in a conveyance direction of the recording material, and configured to convey the recording material to the transfer nip portion, the pair of conveyance members forming a conveyance nip portion, a first drive source configured to drive at least one of the pair of conveyance members so that the recording material is conveyed at a speed of Vr in the conveyance nip portion, a pair of fixing members arranged downstream of the transfer nip portion in the conveyance direction of the recording material, and configured to fix the toner image, which has been transferred onto the recording material in the transfer nip portion, onto the recording material, the pair of fixing members forming a fixing nip portion, a second drive source configured to drive at least one of the pair of fixing members so that the recording material is conveyed at a speed of Vf in the fixing nip portion, an input portion into which information on a basis weight or a thickness of the recording material onto which the toner image is transferred is input, and a control portion configured to control a drive speed of the first drive source so that the Vr is higher than the Vt when the recording material is conveyed in the transfer nip portion, to control a drive speed of the second drive source so that a flexed state is formed in the recording material between the transfer nip portion and the fixing nip portion during a period included in a period during which the recording material is conveyed to both the transfer nip portion and the fixing nip portion, and to control, when the information input into the input portion exceeds a predetermined basis weight or a predetermined thickness, the drive speed of the first drive source so that Vr1 is greater than Vr0, where the Vr0 represents the Vr during a period that is before a downstream edge of the recording material in the conveyance direction reaches the fixing nip portion, and during which the recording material is conveyed to the conveyance nip portion, and the Vr1 represents the Vr during a period that is after the downstream edge of the recording material in the conveyance direction reaches the fixing nip portion, and is included in a period during which the recording material is conveyed to the conveyance nip portion.

Further features of the present invention will become apparent from the following description of exemplary embodiments with reference to the attached drawings.

DESCRIPTION OF THE EMBODIMENTS

An image forming apparatus according to an embodiment of the present invention will be described below with reference to the drawings. In the following description, upper, lower, left, and right directions are represented based on a point viewing the image forming apparatus from a front surface thereof (point of sight of FIG. 1).

[Image Forming Apparatus]

Figure 1:
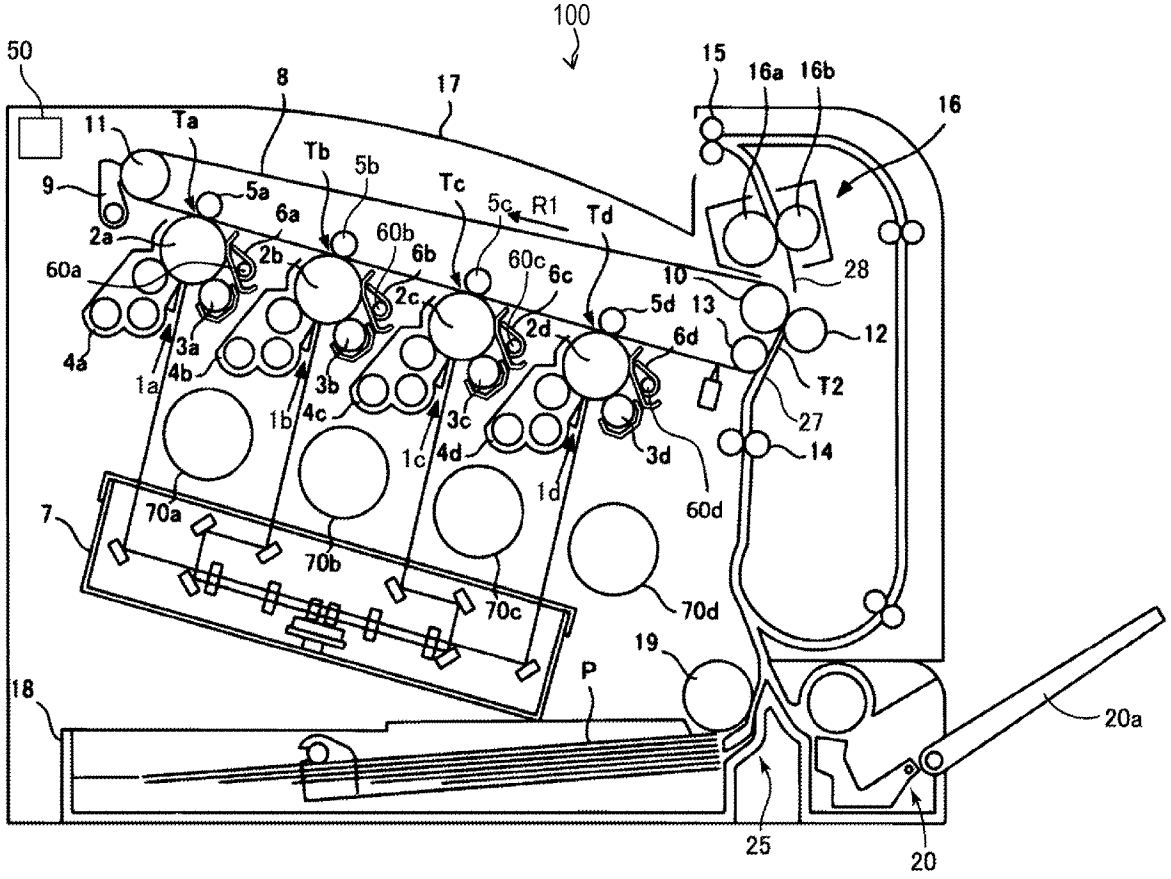
FIG. 1 is a schematic configuration view for illustrating an image forming apparatus according to an embodiment of the present invention.

As illustrated in FIG. 1, an image forming apparatus 100 according to the embodiment is a full-color printer of a so-called tandem-type intermediate transfer system in which four image forming portions (1*a*, 1*b*, 1*c*, and 1*d*), each formed into a cartridge, are arranged along a lower surface of an endless intermediate transfer belt 8. Drum cartridges 1*a*, 1*b*, 1*c*, and 1*d*, serving as the image forming portions, are configured to form a toner image corresponding to toner colors of yellow (Y), magenta (M), cyan (C), and black (Bk), respectively. The image forming apparatus 100 includes the drum cartridges 1*a*, 1*b*, 1*c*, and 1*d*, the intermediate transfer belt 8, a feed portion 25, a registration roller pair 14, a fixing device 16, a control portion 50, and the like.

The drum cartridges 1*a*, 1*b*, 1*c*, and 1*d* are configured substantially in the same manner except that the toner colors used in developing devices 4*a*, 4*b*, 4*c*, and 4*d* are different. The drum cartridge 1*a* will be described below. The descriptions of the other drum cartridges 1*b*, 1*c*, and 1*d* are omitted with suffixes "b", "c", or "d" being replaced by "a".

The drum cartridge 1*a* includes a photosensitive drum 2*a*, and a charging roller 3*a*, the developing device 4*a*, a primary transfer roller 5*a*, and a cleaning device 6*a*, among other features, being arranged around the photosensitive drum 2*a*. The photosensitive drum 2*a* has a photosensitive layer with a negative charging polarity on an outer peripheral surface of an aluminum cylinder, and is driven and rotated in accordance with the rotation direction and rotation speed (process speed) of the intermediate transfer belt 8 by a drive motor (not shown).

The charging roller 3*a* rotates following the rotation of the photosensitive drum 2*a* and is supplied with an oscillating voltage in which an AC voltage is superimposed on a negative DC voltage, to thereby charge the surface of the photosensitive drum 2*a* to a uniform negative potential. The charged portion of the photosensitive drum 2*a* is irradiated with laser light from an exposure device 7 arranged below the drum cartridge 1*a*. The exposure device 7 scans the surface of the photosensitive drum 2*a* with a laser beam that is ON-OFF modulated based on scanning line image data expanding a yellow decomposed color image through use of a rotary mirror, and eliminates the residual charge on the surface of the photosensitive drum 2*a*, to thereby form an electrostatic latent image thereon. The developing device 4*a* supplies a toner to the photosensitive drum 2*a*, to thereby visualize (develop) the electrostatic latent image as a toner image.

The primary transfer roller 5*a* holds the intermediate transfer belt 8 between the primary transfer roller 5*a* and the photosensitive drum 2*a*, and forms a primary transfer portion Ta between the intermediate transfer belt 8 and the photosensitive drum 2*a*. The primary transfer roller 5*a* is supplied with a positive DC voltage, and a toner image having a negative polarity borne on the photosensitive drum 2*a* is primarily transferred onto the intermediate transfer belt 8 in the primary transfer portion Ta. The cleaning device 6*a* removes an adhering substance, such as a transfer residual toner that has passed through the primary transfer portion Ta to remain on the surface of the photosensitive drum 2*a*, with a cleaning blade that is brought into abutment against the photosensitive drum 2*a*. The adhering substance removed by the cleaning device 6*a* is conveyed to a discharge port (not shown) by a toner conveyance screw 60*a* and is discharged to a collecting member, such as a toner collecting bottle.

The intermediate transfer belt 8 that serves as a rotatable image bearing member is wound around a tension roller 11, a drive roller 10, and a tensioning roller 13, and is driven and rotated in a predetermined direction (direction of the arrow R1) by an image formation motor 32 (see FIG. 3) connected to the drive roller 10. The drive roller 10 also serves as an inner-side secondary transfer roller that holds the intermediate transfer belt 8 between the drive roller 10 and a secondary transfer roller 12 (outer-side secondary transfer roller) serving as a rotary member. That is, the drive roller 10 forms a secondary transfer portion T2 serving as a transfer nip portion between the secondary transfer roller 12 and the intermediate transfer belt 8.

The formation process of a toner image described above is performed in parallel in each of the drum cartridges 1*a*, 1*b*, 1*c*, and 1*d*, and toner images of yellow, magenta, cyan, and black are respectively formed. Those toner images are multiple-transferred while being positioned so as to be superimposed on each other (i.e., the toner images of magenta, cyan, and black are superimposed on the toner image of yellow that has been transferred previously) based on the conveyance speed of the intermediate transfer belt 8 set in advance, and thus, a full-color toner image is formed on the intermediate transfer belt 8.

The feed portion 25 includes a cassette 18 in which recording materials P are stacked and a feed roller 19 (separation roller) configured to pull out the recording materials P from the cassette 18 one by one, to thereby feed the recording material P separately. The feed portion 25 conveys the recording material P toward the registration roller pair 14 with the feed roller 19. The recording material P is a sheet material, such as a sheet or a film. Further, a manual feed device 20 is arranged in a lower part of the image forming apparatus 100 so that the recording material P, stacked on a manual feed cassette 20*a* exposed to an outside of a main body of the image forming apparatus 100, can be fed toward the registration roller pair 14.

The recording material P conveyed by the feed portion 25 or the manual feed device 20 stands by in a state in which a downstream edge (leading edge) thereof in the conveyance direction is held in abutment against the registration roller pair 14 in a conveyance stop state. The registration roller pair 14, serving as a conveyance unit, is configured to correct skew feed of the recording material P and to convey the recording material P toward the secondary transfer portion T2 at a timing in accordance with a timing at which the toner image arrives at the transfer position in the secondary transfer portion T2.

The secondary transfer roller 12 is supplied with a positive transfer bias voltage, and the full-color toner image borne on the intermediate transfer belt 8 is collectively transferred (secondarily transferred) onto the recording material P in the secondary transfer portion T2. The fixing device 16, serving as a fixing unit, includes a pressure roller 16*b* and a fixing roller 16*a* having a built-in heating unit, such as a heater, the pressure roller 16*b* being pressed against the fixing roller 16*a*. That is, the fixing device 16 includes the fixing roller 16*a* and the pressure roller 16*b* that serve as a pair of fixing members, and heats and pressurizes the recording material P having passed through the secondary transfer portion T2, to thereby fuse the toner image to fix the image onto the recording material P. The recording material P having the image fixed thereon is delivered to an upper tray 17 formed in an upper part of a housing of the image forming apparatus 100 by delivery rollers 15.

In the image forming apparatus 100, a belt cleaning device 9 configured to clean the intermediate transfer belt 8 is arranged. The belt cleaning device 9 scrapes off and removes an adhering substance such as a transfer residual toner that has passed through the secondary transfer portion T2 to remain on the surface of the intermediate transfer belt 8, with a cleaning blade that is brought into abutment against the intermediate transfer belt 8. Further, toner bottles 70*a*, 70*b*, 70*c*, and 70*d* that are removable from the main body of the image forming apparatus 100 are arranged below the drum cartridges 1*a*, 1*b*, 1*c*, and 1*d*, respectively. The toner bottles 70*a*, 70*b*, 70*c*, and 70*d* accommodate toners of colors corresponding to the respective cartridges, and supply toners when toners are consumed by the developing devices 4*a*, 4*b*, 4*c*, and 4*d*.

[Conveyance Path]

Next, a conveyance path of the recording material P including the registration roller pair 14, the secondary transfer portion T2, and the fixing device 16 will be described. As illustrated in the schematic view of FIG. 2, the recording material P fed from the feed portion 25 is conveyed substantially from the lower part to the upper part inside the image forming apparatus 100 by the registration roller pair 14, the secondary transfer portion T2, and the fixing device 16.

The registration roller pair 14 includes a first registration roller 14*a* and a second registration roller 14*b* that serve as a pair of conveyance members, and a registration nip portion Nr serving as a nip portion (conveyance nip portion) is formed therebetween. The first registration roller 14*a* and the second registration roller 14*b* are each connected to a conveyance motor 31 (see FIG. 3) so as to be driven and rotated, and convey the recording material P held in the registration nip portion Nr upwardly to the secondary transfer portion T2.

As described above, the secondary transfer portion T2 is formed as a nip portion between the intermediate transfer belt 8 having an inner peripheral surface supported by the drive roller 10 and the secondary transfer roller 12. The drive roller 10 and the secondary transfer roller 12 are each connected to the image formation motor 32 (see FIG. 3) so as to be driven and rotated, and convey the recording material P held in the secondary transfer portion T2 upwardly.

The fixing device 16 includes a fixing nip portion Nf formed as a nip portion between the fixing roller 16*a* and the pressure roller 16*b*. The fixing roller 16*a* and the pressure roller 16*b* are each connected to a fixation motor 33 (see FIG. 3) so as to be driven and rotated, and convey the recording material P having passed through the secondary transfer portion T2 upwardly while holding the recording material P in the fixing nip portion Nf. Each roller pair of the first registration roller 14*a* and the second registration roller 14*b*, and the fixing roller 16*a* and the pressure roller 16*b* may have a configuration in which one roller is driven and the other roller rotates following the rotation of the one roller. Further, the secondary transfer roller 12 may rotate following the rotation of the intermediate transfer belt 8.

Figure 2:
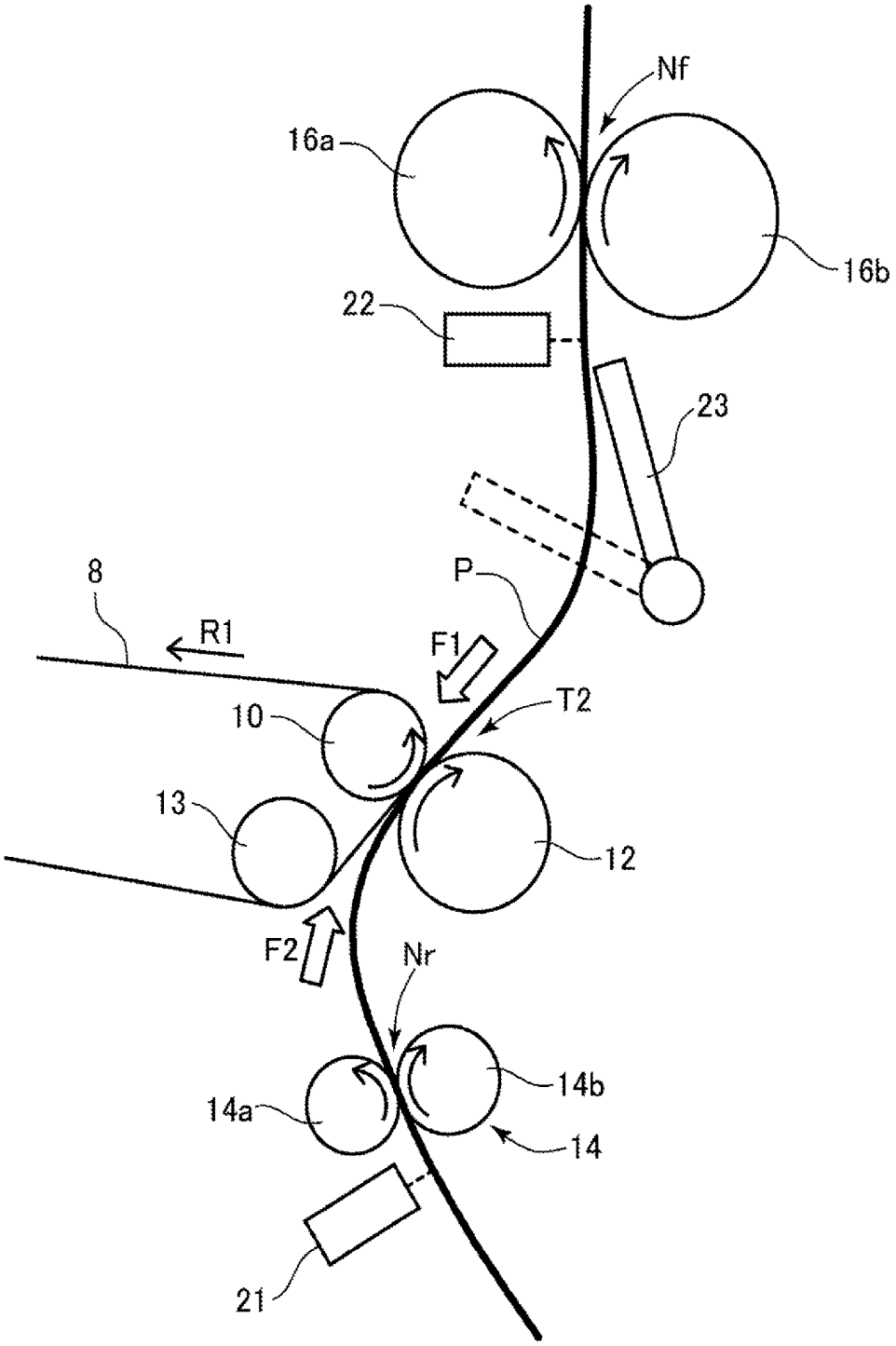
FIG. 2 is a schematic view for illustrating substantial parts of the image forming apparatus according to the embodiment.

A before-transfer guide 27, configured to guide the recording material P toward the secondary transfer portion T2, is arranged between the registration nip portion Nr and the secondary transfer portion T2, and a before-fixation guide 28, configured to guide the recording material P toward the fixing nip portion Nf, is arranged between the secondary transfer portion T2 and the fixing nip portion Nf. For example, as illustrated in FIG. 2, the conveyance directions of the recording material P from the registration nip portion Nr, the secondary transfer portion T2, and the fixing nip portion Nf are inclined at different angles with respect to an up-and-down direction (vertical direction). Thus, the conveyance paths (conveyance spaces) of the recording material P formed by the before-transfer guide 27 and the before-fixation guide 28 are each curved when viewed from a width direction of the recording material P (point of sight of FIG. 1). Those conveyance paths each have a predetermined width in a thickness direction of the recording material P, and are formed so that the recording material P is flexed toward an outer side of the curve in the thickness direction.

A before-registration sensor 21, serving as an upstream-side detection unit configured to detect the recording material P, is arranged at a position close to an upstream side of the registration nip portion Nr in the conveyance direction of the recording material P. The before-registration sensor 21 is configured to detect each timing at which the leading edge that is a downstream edge of the recording material P in the conveyance direction and the trailing edge that is an upstream edge of the recording material P in the conveyance direction enter the registration nip portion Nr. Further, a before-fixation sensor 22, serving as a downstream-side detection unit configured to detect the recording material P, is arranged at a position close to an upstream side of the fixing nip portion Nf, and is configured to detect each timing at which the leading edge and the trailing edge of the recording material P enter the fixing nip portion Nf. Detection signals from the before-registration sensor 21 and the before-fixation sensor 22 are used in part of a speed control process, described later, for controlling the conveyance speed of the recording material P, and are also used, for example, for monitoring a conveyance state (i.e., a presence or an absence of a paper jam).

A loop amount sensor 23, such as a potentiometer, is arranged at a predetermined position between the secondary transfer portion T2 and the fixing nip portion Nf. The loop amount sensor 23 serves as a flexure amount detection unit configured to detect a flexure amount (loop amount) of the recording material P between the secondary transfer portion T2 and the fixing nip portion Nf. The flexure amount (loop amount) of the recording material P refers to a displacement width of the recording material P in the thickness direction when the recording material P has a flexed shape as compared to the state in which the recording material P is stretched between the nip portion on the upstream side and the nip portion on the downstream side in the shortest path.

Figure 3:
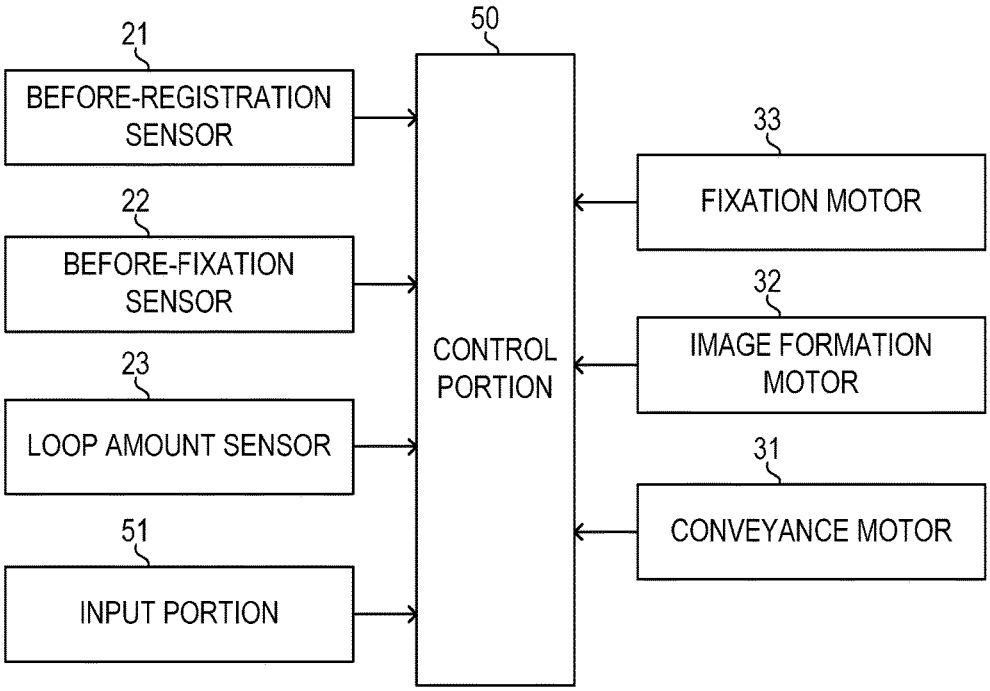
FIG. 3 is a control block diagram for illustrating a control configuration for controlling a conveyance speed of a recording material in the image forming apparatus according to the embodiment.

As illustrated in the block diagram of FIG. 3, a control portion 50, serving as a control unit arranged in the image forming apparatus 100, is connected to an input portion 51, the before-registration sensor 21, the before-fixation sensor 22, and the loop amount sensor 23, respectively, so as to receive signals therefrom. The input portion 51 includes a liquid crystal panel and a button exposed to the outside of the housing of the image forming apparatus 100, and is configured to allow a user to input, to the control portion 50, at least the type (basis weight, size, presence or absence of surface processing) of the recording material P set in the cassette 18. Specific examples of the type of the recording material P include thick paper, plain paper, thin paper, and coated paper. Further, the user may perform setting by, for example, making a selection from a plurality of types of the recording material displayed on the liquid crystal panel. In this case, when the image forming apparatus 100 includes a plurality of cassettes each accommodating different types of recording materials, the type of the recording material to be displayed is set to the types of recording materials in the corresponding cassettes. Further, when a recording material is supplied manually, the user performs setting arbitrarily. In this case, however, the user may also make a selection from the types of the recording material displayed on the liquid crystal panel. Further, the control portion 50 is connected to the conveyance motor 31, the image formation motor 32, and the fixation motor 33, respectively, so as to send control signals to control the rotation speeds thereof.

[Conveyance Speed Control]

Figure 4:
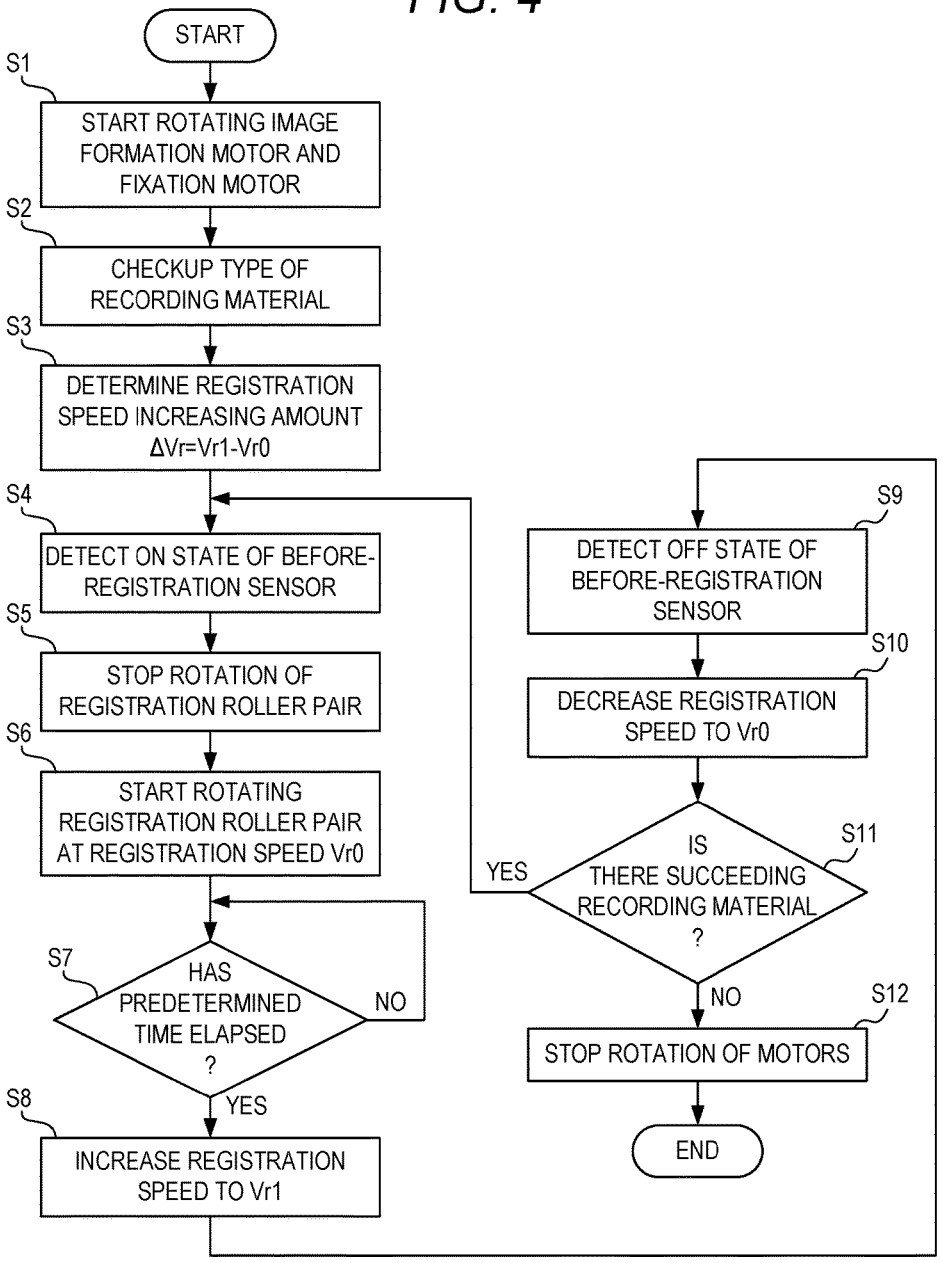
FIG. 4 is a flowchart for illustrating a speed control process according to the embodiment.

Next, a speed control process for controlling the conveyance speed of the recording material P by the control portion 50 according to the embodiment will be described with reference to the flowchart of FIG. 4. The process speed of the image forming apparatus 100 may be changed depending on the type of the recording material, but in each process speed, the magnitude relationship in speed of each portion described later is the same.

The control portion 50 starts feeding the recording material P to the feed portion 25 and starts the speed control process (START). First, the control portion 50 starts rotating the image formation motor 32, to thereby start a toner image formation process in the drum cartridges 1*a*, 1*b*, 1*c*, and 1*d* and to start rotating the fixation motor 33 (S1).

In this case, a secondary transfer speed Vt that is a conveyance speed of the recording material P in the secondary transfer portion T2 is set to a value that is greater than a fixing speed Vf that is a conveyance speed of the recording material P in the fixing nip portion Nf (Vt>Vf). Therefore, when the recording material P is conveyed while being held by the secondary transfer portion T2 and the fixing nip portion Nf, loop (flexure) of the recording material P occurs between the secondary transfer portion T2 and the fixing nip portion Nf due to the difference between the secondary transfer speed Vt and the fixing speed Vf. That is, the recording material P is flexed toward a right side that is the outer side of the curve of the conveyance path between the secondary transfer portion T2 and the fixing nip portion Nf in FIG. 2. In this state, a force in a direction of canceling (extending) the loop occurs inside the recording material P due to rigidity (stiffness) of the recording material P itself. The force acts as a force in a direction of pushing back the intermediate transfer belt and the secondary transfer roller 12 in the secondary transfer portion T2 (braking force), and acts as a force in a direction along the rotation directions of the fixing roller 16*a* and the pressure roller 16*b* in the fixing nip portion Nf.

Next, the control portion 50 checks up the type of the recording material P set in advance (S2), and determines a speed increasing amount ΔVr (ΔVr=Vr1−Vr0) of a registration speed Vr that is a conveyance speed of the recording material P in the registration nip portion Nr (S3). In this case, the control portion 50 acquires information on the basis weight of the recording material P selected from a table (not shown) storing the relationship between the recording material P and the basis weight, based on the type of the recording material P selected by the user as described above, for example. Then, for example, as shown in Table 1, the table associating the basis weight with the speed increasing amount ΔVr is referred to, and the speed increasing amount ΔVr corresponding to the acquired information on the basis weight is determined. At this time, the case in which the registration speed Vr is increased and the case in which the registration speed Vr is not increased are determined depending on the type of the recording material P. That is, when the basis weight of the recording material P is large (151 gsm [g/m$^2$] or more), the speed increasing amount ΔVr is set to a positive value. On the other hand, when the basis weight is small (150 gsm or less), the speed increasing amount ΔVr is set to 0. A method of determining the speed increasing amount ΔVr is not limited thereto. It is sufficient that, as the stiffness (flexure rigidity) of the recording material P is larger, the speed increasing amount ΔVr is increased. Further, when the recording material P is easily charged as coated paper, for example, the speed increasing amount ΔVr may be set to be smaller as compared to those set for the other types of the recording material.

TABLE 1

| Basis weight [gsm] | Speed increasing amount ΔVr |
|---|---|
| 0 to 150 | 0.0% |
| 151 to 180 | 0.3% |
| 181 to 256 | 0.4% |
| 257 to 300 | 0.6% |

When the leading edge of the recording material P fed from the feed portion 25 reaches the before-registration sensor 21, and the detection signal of the before-registration sensor 21 is turned on (S4), the control portion 50 causes the conveyance motor 31 to stop the rotation of the registration roller pair 14 (S5). Then, the leading edge of the recording material P is brought into abutment against the registration nip portion Nr of the registration roller pair 14 in this state (conveyance stop state), and thus, the skew feed of the recording material P is corrected. After that, the registration roller pair 14 starts rotating at a timing in accordance with the transfer timing of the toner image borne on the intermediate transfer belt 8 (S6), and conveys the recording material P toward the secondary transfer portion T2 at the registration speed Vr=Vr0 that is a first conveyance speed. The speed is set to be slightly greater than Vt (Vr0>Vt).

Then, the control portion 50 causes the registration roller pair 14 to rotate continuously until a predetermined period of time elapses. The predetermined period of time refers to a period of time set in advance so that the leading edge of the recording material P can reach the fixing nip portion Nf after the conveyance of the recording material P by the registration roller pair 14 is started at the registration speed Vr=Vr0. The control portion 50 increases the rotation speed of the registration roller pair 14 by the speed increasing amount ΔVr at a timing at which the predetermined period of time elapses from the start of the rotation of the registration roller pair 14, and switches the registration speed Vr from Vr0 to Vr1 that is a second conveyance speed (S8).

When the trailing edge of the recording material P passes through the before-registration sensor 21, the detection signal of the before-registration sensor 21 is turned off (S9). Then, the control portion 50 decelerates the registration roller pair 14 at a timing after the trailing edge of the recording material P passes through the registration nip portion Nr, and decreases the registration speed Vr from Vr1 to Vr0 (S10). The control portion 50 checks up the presence or absence of the recording material P to be fed succeedingly. When there is the succeeding recording material P (S11: YES), the control portion 50 stands by until the trailing edge of the succeeding recording material P reaches the before-registration sensor 21, and repeats the processing from Step 4 (S4). When there is no succeeding recording material P (S11: NO), the control portion 50 stops the rotations of the conveyance motor 31, the image formation motor 32, and the fixation motor 33 at a timing after the recording material P is delivered to the upper tray 17 (S12), to thereby complete the speed control process (END).

Figure 5A:
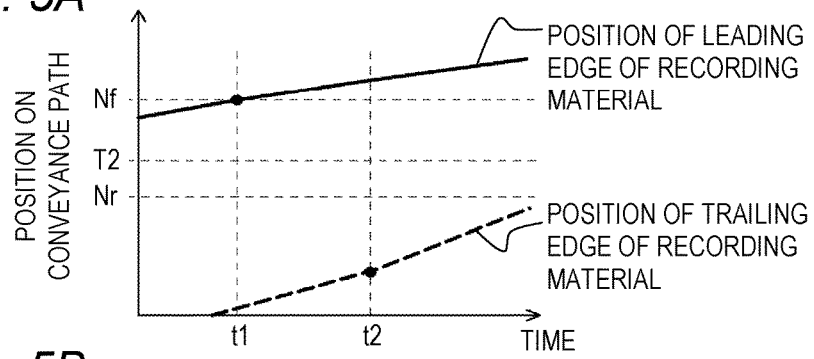
FIG. 5A is a graph for showing a change in leading edge position and a trailing edge position of the recording material with time.
Figure 5B:
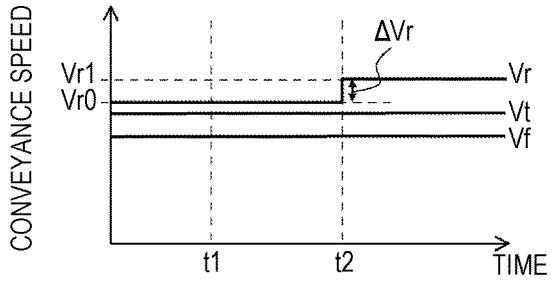
FIG. 5B is a graph for showing a change in a conveyance speed of the recording material with time.
Figure 5C:
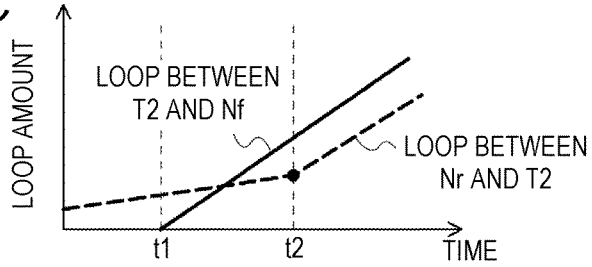
FIG. 5C is a graph for showing a change in a loop amount of the recording material with time.
Figure 5D:
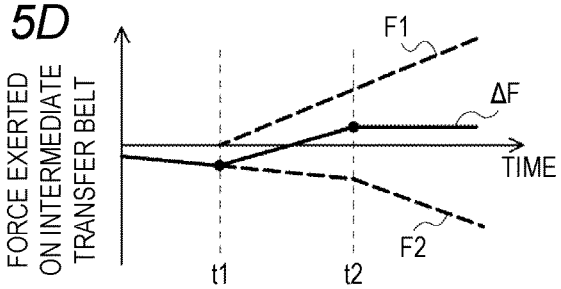
FIG. 5D is a graph for showing a change in a force exerted on an intermediate transfer belt from the recording material.

How the loop amount of the recording material P and the force exerted on the intermediate transfer belt 8 are changed by increasing the registration speed Vr will be described below with reference to FIG. 5A, FIG. 5B, FIG. 5C, and FIG. 5D. Here, the secondary transfer speed Vt and the fixing speed Vf are each defined to be constant. Further, a time t1 and a time t2 represent a time when the leading edge of the recording material P reaches the fixing nip portion Nf, and a time when the registration speed Vr is increased from Vr0 to Vr1, respectively. FIG. 5A is a graph for showing a change with time in position of the leading edge and the trailing edge of the recording material P on the conveyance path. FIG. 5B is a graph for showing a change with time in conveyance speed of the recording material P in the registration nip portion Nr, the secondary transfer portion T2, and the fixing nip portion Nf (registration speed Vr, secondary transfer speed Vt, fixing speed Vf). FIG. 5C is a graph for showing a change with time in a loop amount of the recording material P between the registration nip portion Nr and the secondary transfer portion T2 (loop between Nr and T2), and a loop amount of the recording material P between the secondary transfer portion T2 and the fixing nip portion Nf (loop between T2 and Nf). FIG. 5D is a graph for showing a change with time in force exerted on the intermediate transfer belt 8 from the recording material P in the secondary transfer portion T2.

As described above, the fixing speed Vf is set to be less than the secondary transfer speed Vt (FIG. 5B). Therefore, when the leading edge of the recording material P reaches the fixing nip portion Nf, a loop (flexure) of the recording material P occurs between the secondary transfer portion T2 and the fixing nip portion Nf due to the difference between the secondary transfer speed Vt and the fixing speed Vf, and the loop amount increases with time (solid line of FIG. 5C). When the recording material P is flexed as described above, a force F1 in a direction opposing the rotation direction (see FIG. 2) is exerted on the intermediate transfer belt 8 in the secondary transfer portion T2 due to the rigidity (stiffness) of the recording material P. The force F1 increases as the loop amount between the secondary transfer portion T2 and the fixing nip portion Nf increases, and hence, the force F1 increases with time (FIG. 5D). In FIG. 5D, an upper side of a time axis represents a force in a direction opposite to the rotation direction of the intermediate transfer belt 8 (direction of the arrow R1) (braking direction), and a lower side of the time axis represents a force in a direction along the rotation direction of the intermediate transfer belt 8.

Meanwhile, the registration speed Vr (Vr0) before an increase in speed is set to be slightly greater than the secondary transfer speed Vt, and hence, a loop (flexure) occurs in the recording material P between the registration nip portion Nr and the secondary transfer portion T2. Then, the loop amount between the registration nip portion Nr and the secondary transfer portion T2 increases gradually also in the time until the registration speed Vr is increased to Vr1 (FIG. 5C). When the registration speed Vr is increased to Vr1, the difference between the registration speed Vr and the secondary transfer speed Vt increases. Then, the loop amount between the registration nip portion Nr and the secondary transfer portion T2 rapidly increases as compared to the state before the leading edge of the recording material P reaches the fixing nip portion Nf.

When the loop occurs between the registration nip portion Nr and the secondary transfer portion T2, a force F2 in a direction along the rotation direction that is an opposite direction of the force F1 described above is exerted on the intermediate transfer belt 8 in the secondary transfer portion T2 due to the rigidity (stiffness) of the recording material P (see FIG. 2). Further, when the registration speed Vr is increased from Vr0 to Vr1, the rate of increase of the loop amount between the registration nip portion Nr and the secondary transfer portion T2 increases as compared to that before increase in speed, and hence, the rate of increase of the force F2 also increases (FIG. 5D). A value of the speed Vr1 is set so that the rate of increase of the loop amount between the registration nip portion Nr and the secondary transfer portion T2 becomes substantially equal to that of the loop amount between the secondary transfer portion T2 and the fixing nip portion Nf (FIG. 5C). Thus, in the secondary transfer portion T2, a difference ($\Delta F = F1 - F2$) between the force F1 that is a force (braking force) exerted on the intermediate transfer belt 8 from the recording material P and the force F2 is prevented from increasing by increasing the registration speed Vr (FIG. 5D).

Effects of Embodiment

In the case of the image forming apparatus 100 according to the embodiment, the registration speed Vr is controlled so as to be greater than the previous speed (Vr0) in at least part of a period of time from a time when the leading edge of the recording material P reaches the fixing nip portion Nf to a time when the trailing edge of the recording material P passes through the registration nip portion Nr. With this, the force F2 with which the registration roller pair 14 pushes the recording material P into the secondary transfer portion T2 is increased, to thereby cancel out the force F1 exerted on the intermediate transfer belt 8 due to the flexure (loop) formed between the secondary transfer portion T2 and the fixing nip portion Nf. Therefore, an increase in force in a direction opposing the rotation direction (braking force) exerted on the intermediate transfer belt 8 from the recording material P is suppressed, and the influence on the rotation speed of the intermediate transfer belt 8 is reduced, to thereby prevent the occurrence of color misregistration, and the like.

Here, as a comparative example of the embodiment, there is conceivable a configuration in which the registration speed Vr is increased averagely. For example, there is given a configuration in which the registration speed Vr is set to a value between Vr0 and Vr1 during a period of time from a time when the registration roller pair 14 starts rotating to a time when the trailing edge of the recording material P passes through the registration nip portion Nr. With such a configuration, however, the loop amount between the registration nip portion Nr and the secondary transfer portion T2 increases rapidly as compared to the embodiment during a period of time from a time when the leading edge of the recording material P reaches the secondary transfer portion T2 to a time when the leading edge reaches the fixing nip portion Nf. Then, when the recording material P is significantly flexed between the registration nip portion Nr and the secondary transfer portion T2, the recording material P may be brought into contact with the intermediate transfer belt 8 at an upstream position of the secondary transfer portion T2, to thereby distort the toner image borne on the intermediate transfer belt 8.

Meanwhile, in the speed control process according to the embodiment, the speed increasing timing of the registration speed Vr is set to substantially the same timing at which the leading edge of the recording material P reaches the fixing nip portion Nf or after that timing. Therefore, at least until the registration speed Vr is increased, the recording material P can be prevented from being significantly flexed between the registration nip portion Nr and the secondary transfer portion T2 to cause an image defect. That is, the recording material P is not flexed more than necessary on an upstream side of the secondary transfer portion T2, and hence, the influence on the rotation speed of the intermediate transfer belt 8 can be reduced.

MODIFIED EXAMPLE 1

As a modified example of the above-mentioned speed control process, the speed increasing timing of the registration speed Vr may be determined based on a signal from the before-fixation sensor 22 instead of the method of determining the speed increasing timing based on an elapsed time from the start of conveyance by the registration roller pair 14. In this case, it is preferred that the registration speed Vr be increased at a timing at which the detection signal of the before-fixation sensor 22 is turned on, and the control portion 50 detects that the leading edge of the recording material P reaches the fixing nip portion Nf. With this configuration, the influence of a variation in conveyance speed of the recording material P between the secondary transfer portion T2 and the fixing nip portion Nf is eliminated, and hence, as compared to the above-mentioned embodiment, the control portion 50 can detect the positional relationship between the leading edge of the recording material P and the fixing nip portion Nf more accurately. Then, the speed increasing timing of the registration speed Vr can be set more accurately by, for example, bringing the speed increasing timing of the registration speed Vr close to the timing at which the leading edge of the recording material P enters the fixing nip portion Nf.

MODIFIED EXAMPLE 2

As another modified example of the speed control process, the speed increasing timing of the registration speed Vr may also be determined based on a signal from the loop amount sensor 23. In this case, the detection signal of the loop amount sensor 23 is turned on when the loop amount between the secondary transfer portion T2 and the fixing nip portion Nf is equal to or greater than the maximum loop amount set in advance. Then, it is preferred that the registration speed Vr be increased at a timing at which the loop amount sensor 23 is turned on. With this configuration, when the loop amount between the secondary transfer portion T2 and the fixing nip portion Nf increases, and a large braking force may be exerted on the intermediate transfer belt 8, the registration speed Vr can be increased to suppress an increase in braking force. On the other hand, when the loop amount between the secondary transfer portion T2 and the fixing nip portion Nf is small, the registration speed Vr is not increased, and hence, the rate of increase of the loop amount between the registration nip portion Nr and the secondary transfer portion T2 is kept relatively small. That is, while the influence on the rotation speed of the intermediate transfer belt 8 is reduced, the registration speed Vr can be set to be small in accordance with the loop amount between the secondary transfer portion T2 and the fixing nip portion Nf as compared to the above-mentioned embodiment.

Another Embodiment

In the above-mentioned embodiment, the image bearing member that is brought into contact with the recording material P in the transfer nip portion is not limited to the intermediate transfer belt 8, and may be, for example, a drum-like intermediate transfer body or a photosensitive drum in a monochromatic image forming apparatus of a direct transfer system. In short, the image bearing member may be any member that forms the transfer nip portion, in which the recording material P is held between the member and the rotary member and the toner image can be transferred onto the recording material P, between the conveyance nip portion on an upstream side and the fixing nip portion on a downstream side. The rotary member may be a belt member, such as a secondary transfer belt, instead of the secondary transfer roller 12. Further, the conveyance unit arranged on the upstream side of the transfer nip portion may be another conveyance member pair instead of the registration roller pair, as long as the conveyance member pair can hold and convey the recording material P.

In the above-mentioned speed control process, the timing at which the registration speed Vr is increased may be after the timing at which the leading edge of the recording material P reaches the fixing nip portion Nf. Further, the timing at which the registration speed Vr is decreased may be before the timing at which the trailing edge of the recording material P passes through the registration nip portion Nr. In short, it is sufficient that the registration speed be increased as compared to the previous registration speed in at least part of a period of time from a time when the leading edge of the recording material P reaches the fixing nip portion Nf to a time when the trailing edge of the recording material P passes through the registration nip portion Nr. In this case, it is preferred that the length of time during which the registration speed is increased be appropriately set within a range of a predetermined maximum length or less, so that the loop amount between the registration nip portion Nr and the secondary transfer portion T2 does not exceed an upper limit set in advance. With this configuration, for example, when the size of the recording material P is large, it is possible to further reduce the risk that the recording material P is brought into contact with the intermediate transfer belt at an upstream position of the secondary transfer portion T2 to distort the toner image.

Further, the secondary transfer speed Vt and the fixing speed Vf according to the embodiment may be set to constant values with respect to the process speed of the image forming apparatus 100, so that a loop is formed in the recording material P between the secondary transfer portion T2 and the fixing nip portion Nf. In this case, the loop amount sensor 23 may be omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a movable endless belt;

a toner image forming unit configured to form a toner image on the belt;

a transfer rotary member forming a transfer nip portion with the belt, and configured to transfer the toner image, formed on the belt, onto a recording material;

a pair of conveyance members arranged upstream of the transfer nip portion in a conveyance direction of the recording material, and configured to convey the recording material to the transfer nip portion, the pair of conveyance members forming a conveyance nip portion;

a first drive source configured to drive at least one of the pair of conveyance members;

a pair of fixing members arranged downstream of the transfer nip portion in the conveyance direction of the recording material, and configured to fix the toner image, which has been transferred onto the recording material in the transfer nip portion, onto the recording material, the pair of fixing members forming a fixing nip portion;

a second drive source configured to drive at least one of the pair of fixing members; and a control portion configured to control:

(a) a drive speed of the first drive source, so that a speed of the recording material conveyed in the conveyance nip portion is greater than a speed of the recording material conveyed in the transfer nip portion; and (b) a drive speed of the second drive source, so that the speed of the recording material conveyed in the transfer nip portion is greater than a speed of the recording material conveyed in the fixing nip portion, wherein the control portion changes a rotation speed of the pair of conveyance members from a first speed to a second speed greater than the first speed after a first loop amount of the recording material, formed between the transfer nip portion and the fixing nip portion, becomes greater than a second loop amount of the recording material, formed between the transfer nip portion and the conveyance nip portion.

2. The image forming apparatus according to claim 1, wherein the belt comprises an intermediate transfer belt configured to move while bearing the toner image, which is to be transferred onto the recording material, after being transferred onto the intermediate transfer belt from the toner image forming unit.

3. The image forming apparatus according to claim 1, wherein the pair of conveyance members comprises a registration roller pair configured to convey the recording material toward the transfer nip portion in accordance with a timing at which a region of the toner image, formed on the belt and to be transferred onto the recording material, reaches the transfer nip portion.

4. The image forming apparatus according to claim 1, wherein the control portion changes the drive speed of the first drive source from the first speed to the second speed, greater than the first speed, after a predetermined time elapses since the pair of conveyance members starts to convey the recording material.

5. The image forming apparatus according to claim 1, further comprising a detection member arranged downstream of the transfer nip portion and upstream of the fixing nip portion in the conveyance direction of the recording material, the detection member being configured to detect a downstream edge of the recording material in the conveyance direction, wherein the control portion is configured to control the drive speed of the first drive source so that the drive speed is increased based on a detection result of the detection member.

6. The image forming apparatus according to claim 1, further comprising a detection member arranged between the transfer nip portion and the fixing nip portion, the detection member being configured to detect a loop amount of the recording material formed between the transfer nip portion and the fixing nip portion, wherein the control portion is configured to control the drive speed of the first drive source so that the drive speed is increased based on a detection result of the detection member.

7. The image forming apparatus according to claim 3, wherein the control portion is configured to control the drive speed of the first drive source on the basis of an elapsed time since the registration roller pair is started to be driven.

8. The image forming apparatus according to claim 1, wherein the first loop amount is maintained so as to be greater than the second loop amount until a trailing edge of the recording material passes through the conveyance nip portion, after the first loop amount has become greater than the second loop amount.

9. The image forming apparatus according to claim 1, wherein the control portion controls the pair of conveyance members such that the rotation speed thereof is the first speed until a leading edge of the recording material passes through the fixing nip portion, after the leading edge has passed through the transfer nip portion.

10. An image forming apparatus comprising:

a movable endless belt;

a toner image forming unit configured to form a toner image on the belt;

a transfer rotary member forming a transfer nip portion with the belt, and configured to transfer the toner image, formed on the belt, onto a recording material at the transfer nip portion;

a pair of conveyance members arranged upstream of the transfer nip portion in a conveyance direction of the recording material, and configured to form a conveyance nip portion for conveying the recording material to the transfer nip portion;

a first drive source configured to drive at least one of the pair of conveyance members;

a pair of fixing members arranged downstream of the transfer nip portion in the conveyance direction of the recording material, and configured to form a fixing nip portion for fixing the toner image, which has been transferred onto the recording material in the transfer nip portion, onto the recording material;

a second drive source configured to drive at least one of the pair of fixing members;

an input portion configured to input information regarding a weight per unit area of the the recording material; and a control portion configured to control:

(a) a drive speed of the first drive source, so that a speed of the recording material conveyed in the conveyance nip portion is greater than a speed of the recording material conveyed in the transfer nip portion; and (b) a drive speed of the second drive source, so that the speed of the recording material conveyed in the transfer nip portion is greater than a speed of the recording material conveyed in the fixing nip portion, wherein the control portion controls the drive speed of the first drive source to a first predetermined speed in at least a portion of a period of time from a time when a leading edge of the recording material reaches the fixing nip portion to a time when a trailing edge of the recording material reaches the conveyance portion, in a case in which the input information indicates that the weight per unit area of the recording material is a first weight per unit area, wherein the control portion controls the drive speed of the first drive source to a second predetermined speed that is greater than the first predetermined speed in at least a portion of the period of time from the time when the leading edge of the recording material reaches the fixing nip portion to the time when the trailing edge of the recording material reaches the conveyance portion, in a case the input information indicates the weight per unit area of the recording material is a second weight per unit area that is greater than the first weight per unit area, and wherein the first predetermined speed and the second predetermined speed are greater than the drive speed of the first drive source in a period of time from a time when the pair of conveyance members starts to convey the recording material to a time when the leading edge of the recording material reaches the fixing nip portion.

11. The image forming apparatus according to claim 10, wherein the control portion controls the drive speed of the first drive source based on an elapsed time since the recording material starts to be conveyed by the pair of conveyance members.

12. An image forming apparatus comprising:

a movable endless belt;

a toner image forming unit configured to form a toner image on the belt;

a transfer rotary member forming a transfer nip portion with the belt, and configured to transfer the toner image, formed on the belt, onto a recording material at the transfer nip portion;

a pair of conveyance members arranged upstream of the transfer nip portion in a conveyance direction of the recording material, and configured to form a conveyance nip portion for conveying the recording material to the transfer nip portion;

a first drive source configured to drive at least one of the pair of conveyance members;

a pair of fixing members arranged downstream of the transfer nip portion in the conveyance direction of the recording material, and configured to form a fixing nip portion for fixing the toner image, which has been transferred onto the recording material in the transfer nip portion, onto the recording material;

a second drive source configured to drive at least one of the pair of fixing members; and a control portion configured to control:

(a) a drive speed of the first drive source, so that a speed of the recording material conveyed in the conveyance nip portion is greater than a speed of the recording material conveyed in the transfer nip portion; and (b) a drive speed of the second drive source, so that the speed of the recording material conveyed in the transfer nip portion is greater than a speed of the recording material conveyed in the fixing nip portion, wherein the control portion controls the drive speed of the first drive source to a predetermined speed in at least a portion of a first period of time from a time when a leading edge of the recording material reaches the fixing nip portion to a time when a trailing edge of the recording material reaches the conveyance portion, the predetermined speed being greater than the drive speed of the first drive source in a second period of time from a time when the pair of conveyance members starts to convey the recording material to a time when the leading edge of the recording material reaches the fixing nip portion.

13. The image forming apparatus according to claim 12, wherein the belt comprises an intermediate transfer belt configured to move while bearing the toner image, which is to be transferred onto the recording material, after being transferred onto the intermediate transfer belt from the toner image forming unit.

14. The image forming apparatus according to claim 12, wherein the pair of conveyance members is configured to convey the recording material toward the transfer nip portion in accordance with a timing at which a region of the toner image, formed on the belt and to be transferred onto the recording material, reaches the transfer nip portion.

15. The image forming apparatus according to claim 12, wherein the control portion changes the drive speed of the first drive source from the first speed to the second speed after a predetermined time elapses since the pair of conveyance members starts to convey the recording material.

16. The image forming apparatus according to claim 12, further comprising an input portion configured to input information regarding a weight per unit area of the recording material, wherein the control portion controls the drive speed of the first drive source to the predetermined speed in at least a portion of the first period, in a case in which the information indicates the weight per unit area of the recording material is greater than a predetermined weight per unit area.

* * * * *